US010487291B2

(12) United States Patent
Veith et al.

(10) Patent No.: US 10,487,291 B2
(45) Date of Patent: Nov. 26, 2019

(54) DETERGENT OR CLEANING AGENT HAVING GLDA-ENHANCED ANTIMICROBIAL EFFECT

(71) Applicant: Henkel AG & Co. KGaA, Duesseldorf (DE)

(72) Inventors: Birgit Veith, Duesseldorf (DE); Mirko Weide, Duesseldorf (DE); Christian Kastner, Duesseldorf (DE); Ulrich Baeumer, Neuss (DE); Roland Breves, Mettmann (DE); Stefan Karsten, Gummersbach (DE)

(73) Assignee: Henkel AG & Co. KGaA (DE)

( * ) Notice: Subject to any disclaimer, the term of this patent is extended or adjusted under 35 U.S.C. 154(b) by 0 days.

(21) Appl. No.: 16/111,418

(22) Filed: Aug. 24, 2018

(65) Prior Publication Data

US 2019/0055493 A1 Feb. 21, 2019

Related U.S. Application Data

(63) Continuation of application No. PCT/EP2017/053808, filed on Feb. 20, 2017.

(30) Foreign Application Priority Data

Feb. 24, 2016 (DE) ..... 10 2016 202 846

(51) Int. Cl.

| | |
|---|---|
| ***C11D 1/86*** | (2006.01) |
| ***C11D 1/62*** | (2006.01) |
| ***C11D 3/20*** | (2006.01) |
| ***C11D 3/48*** | (2006.01) |

(52) U.S. Cl.
CPC ..... *C11D 1/62* (2013.01); *C11D 3/2082* (2013.01); *C11D 3/48* (2013.01)

(58) Field of Classification Search
CPC .... C11D 1/12; C11D 1/62; C11D 1/86; C11D 3/33; C11D 3/48
See application file for complete search history.

(56) References Cited

U.S. PATENT DOCUMENTS

| | | | | |
|---|---|---|---|---|
| 2003/0100465 | A1 | 5/2003 | Vickers | |
| 2006/0111265 | A1* | 5/2006 | Rypkema | C11D 1/835 510/504 |
| 2010/0227930 | A1 | 9/2010 | Lusignan | |
| 2011/0117032 | A1* | 5/2011 | Gilding | A01N 33/08 424/54 |
| 2012/0225948 | A1* | 9/2012 | Heisig | A01N 33/12 514/642 |
| 2015/0282480 | A1* | 10/2015 | Kloeppel | A01N 33/12 422/28 |

FOREIGN PATENT DOCUMENTS

| | | | |
|---|---|---|---|
| EP | 0000224 | A1 | 1/1979 |
| WO | 9817759 | A1 | 4/1998 |
| WO | 2004/009754 | A1 | 1/2004 |
| WO | 2012055775 | A1 | 5/2012 |
| WO | 2013064340 | A1 | 5/2013 |

OTHER PUBLICATIONS

PCT International Search Report PCT/EP2017/053808 Completed: Apr. 24, 2017; dated May 4, 2017 3 pages.

* cited by examiner

*Primary Examiner* — Charles I Boyer
(74) *Attorney, Agent, or Firm* — Thomas G. Krivulka

(57) ABSTRACT

A detergent or cleaning agent that has an antimicrobial effect and includes at least one tetracarboxylic acid or the salts thereof in combination with at least one biocidal quaternary ammonium compound.

3 Claims, 1 Drawing Sheet

DETERGENT OR CLEANING AGENT HAVING GLDA-ENHANCED ANTIMICROBIAL EFFECT

FIELD OF THE INVENTION

The present invention relates to a washing or cleaning agent having an antimicrobial effect, which agent comprises at least one tetracarboxylic acid or salts thereof in conjunction with at least one biocidal quaternary ammonium compound.

BACKGROUND OF THE INVENTION

Microorganisms can be a substantial hygiene and health problem in the household. The adherence of microorganisms to surfaces is undesirable, in particular in the case of pathogenic microorganisms. Adherent microorganisms often lead to infections or to re-infections in humans, animals and even plants.

Delicate textiles such as silks or microfibers are being increasingly made into clothing that can only be washed at 30 or 40° C. Microorganisms are not safely killed off at such temperatures. In addition to the lower washing temperatures, it is also usual nowadays to use liquid washing agents that are generally free of bleaching agents, which are antimicrobially active. In addition, problems with unpleasant odors may also occur because remaining germs reproduce on the laundry during drying, wearing or storage and produce malodorous metabolic products.

However, the problem of the adhesion of microorganisms exists not only on clothing or other textile fabrics, such as hand towels or bed linen, but also when cleaning in the household itself, for example hard surfaces such as floors, baths or even dishes.

The prevailing washing behavior means that textiles or surfaces contaminated with viruses, bacteria or other microorganisms cannot be sterilized to the required degree, causing infection or re-infection in certain circumstances.

Antimicrobially active compounds and compositions as well as the use thereof in washing agents are known in the prior art. For example, WO 2013/064340 A1 discloses a cleaning agent for hard surfaces having a pH in the range of from 9 to 12, which agent comprises benzalkonium chloride, a salt of di- or tricarboxylic acids, sodium tripolyphosphate and water.

WO 2012/055775 A1 describes quaternary ammonium compounds (QAC) as microbially active compounds in liquid washing or cleaning agents. However, it is precisely in such washing, cleaning or disinfecting formulations which have biocidal quaternary ammonium compounds that a concentration-dependent poor level of activity has been shown, in particular in the case of gram-negative bacteria. Said bacteria occur in particular in moist regions, as prevail in the bath or on damp laundry.

BRIEF SUMMARY OF THE INVENTION

A problem addressed by the present invention is therefore that of providing an antimicrobially active washing or cleaning agent having at least one quaternary ammonium compound in which the antimicrobial activity with respect to known formulations is improved.

Surprisingly, it has been shown that an improved antimicrobial effect of the quaternary ammonium compounds can be achieved by means of tetracarboxylic acids or salts thereof, although tetracarboxylic acids or salts thereof are not antimicrobially active themselves. Surprisingly, a synergistic effect has been found between the quaternary ammonium compounds and tetracarboxylic acids or salts thereof.

By using a washing or cleaning agent according to the invention, a hygiene effect can thus be achieved, even at low washing temperatures and using liquid washing agents, that is comparable with the hygiene performance of bleach-containing powdered washing agents at high temperatures of 60° C. or more. For cleaning agents of hard surfaces, a prevailing poor level of activity against pseudomonads or other microorganisms can be resolved in this way.

The washing or cleaning agent according to the invention comprises at least one tetracarboxylic acid or salts thereof (tetracarbonates). In this case, the tetracarboxylic acid preferably has one of the following general structures (Ia), (Ib) or (Ic):

(Ia)

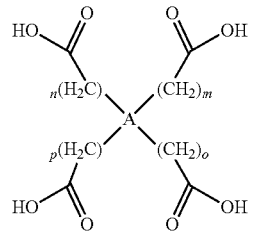

(Ib)

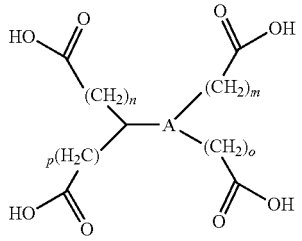

(Ic)

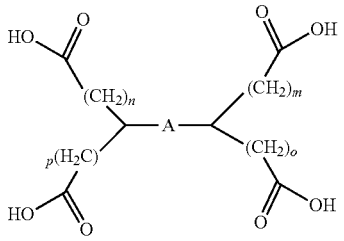

The corresponding tetracarbonates correspondingly have the following general structures (IIa), (IIb) or (IIc):

(IIa)

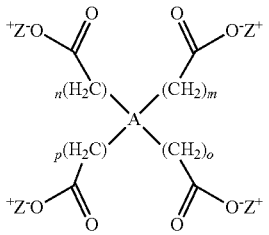

-continued (IIb)

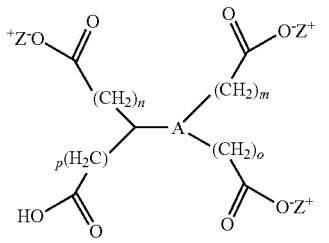

(IIc)

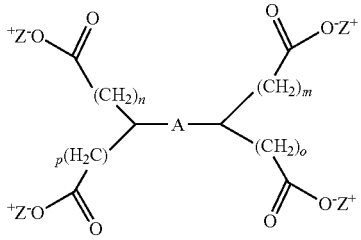

If tetracarboxylic acids are described in the following, tetracarbonates are correspondingly also to be understood thereby and vice versa.

In the general structural formulas (Ia), (Ib) and (Ic) and (IIa), (IIb) and (IIc), m, n, o and p, independently of one another, each stand for natural integers in the range of from 0 to 10, in particular 0 to 8, preferably 1 to 6, particularly 1 to 5 and particularly preferably for 0, 1, 2, 3 or 4, and in particular for 0, 1 or 2.

The salt is preferably ammonium and/or alkali metal salt; $Z^+$ preferably stands for $NH_4^+$, $Na^+$ or $K^+$.

A is preferably selected from a substituted or unsubstituted alkyl or aryl functional group having 2 to 14 carbon atoms, or an element of the 14th, 15th or 16th group of the periodic table (PTE). These are naturally limited according to the valency of the atoms. It is therefore obvious to a person skilled in the art that, in formula (Ia) or (IIa), A does not stand for an element of the 15th or 16th group of the PTE, and likewise in formula (Ib) or (IIb), elements of the 16th group are excluded. Provided that as A has an open valency, a hydrogen atom is bonded thereto.

"Alkyl" refers to a saturated aliphatic hydrocarbon, including straight-chain and branched-chain groups. The alkyl group preferably has 2 to 10 carbon atoms (when a numerical range such as "2 to 10" is stated herein, this means that this group, in the present case the alkyl group, may have 2 carbon atoms, 3 carbon atoms, etc., up to and including 10 carbon atoms). In particular, the alkyl may be a medium alkyl, having 2 to 6 carbon atoms, or a lower alkyl, having 2 to 4 carbon atoms, for example ethyl, n-propyl, isopropyl, butyl, isobutyl, tert-butyl, etc.

"Aryl" refers to monocyclic or polycyclic (i.e., rings having shared neighboring carbon atom pairs) groups made up in particular of 6 to 14 carbon ring atoms that have a complete conjugated pi electron system. Examples of aryl groups are phenyl, naphthalenyl, and anthracenyl.

The alkyl functional group and/or the aryl functional group may be substituted. "Substituted," as used herein in conjunction with the substituents and functional groups according to the invention, means that, in the group in question, one or more H atoms and/or one or more C atoms are replaced by other functional groups, these functional groups being selected in particular from those containing one or more heteroatoms. In various embodiments, the substituents are selected from =O, =S, —OH, —SH, $—NH_2$, $—NO_2$, —CN, —F, —Cl, —Br, $C_{1-10}$ alkyl, $C_{2-10}$ alkenyl, $C_{2-10}$ alkynyl, $C_{3-8}$ cycloalkyl, $C_{6-14}$ aryl, a 5- to 10-membered heteroaryl ring in which 1 to 4 ring atoms are independently nitrogen, oxygen or sulfur, and a 5- to 10-membered heteroalicyclic ring in which 1 to 3 ring atoms are independently nitrogen, oxygen or sulfur.

Particularly preferably, the tetracarboxylic acid has the general structural formula (Ib). Here, A preferably stands for an element of the 15th group of the PTE. It is particularly preferably nitrogen (N) or phosphorus (P). Particularly preferably, A stands for N.

In this preferred embodiment, m, n, o and p, independently of one another, each stand for 0, 1, 2, 3 or 4, in particular for 0, 1 or 2. Particularly preferably, the tetracarboxylic acid is glutamic acid-N,N-diacetic acid, in which n=0, m and o=1 and p=2 and A stands for N.

DETAILED DESCRIPTION OF THE INVENTION

Figure 1:
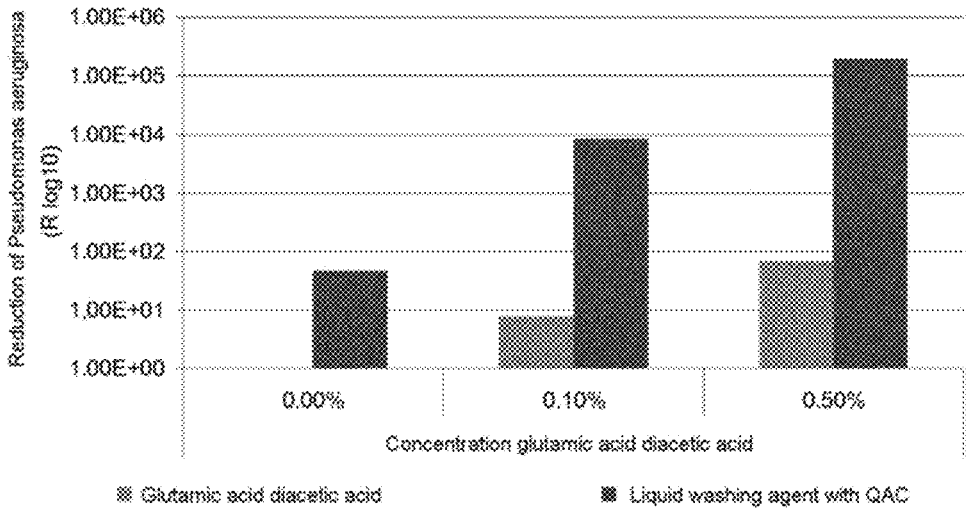
FIG. 1 shows the antibacterial effect based on the concentration of glutamic acid diacetic acid in a liquid washing agent with QAC.

The washing or cleaning agent preferably comprises at least 0.05 wt. % or more, based on the total weight of the washing or cleaning agent, of the at least one tetracarboxylic acid or salts thereof. It has been found that this proportion is necessary to allow the QAC to have an enhancing effect. The washing or cleaning agent preferably comprises the tetracarboxylic acids in a proportion of from 0.05 wt. % to 5 wt. %, in particular 0.05 wt. % to 3 wt. %, preferably 0.1 wt. % to 1 wt. %. Amounts higher than this do not lead to additional enhancement of the antimicrobial effect of the QAC, and therefore "more" does not lead to a substantial improvement in performance.

Without being bound to this theory, it is assumed that the tetracarboxylic acid, owing to the properties as a chelating agent, allows access to the cell membrane of the microbes such that the QAC have an improved attack effect. Surprisingly, it has been shown that the tetracarboxylic acids are functional for both acidic and neutral as well as alkaline pH values. The washing or cleaning agent according to the invention can thus have a pH of 7, >7 or <7.

The liquid washing or cleaning agent contains a biocidally active quaternary ammonium compound as an essential component. Quaternary ammonium compounds (QAC) that are suitable as biocidal active ingredients have the general formula $(R^1)(R^2)(R^3)(R^4)N^+X''$, in which $R^1$ to $R^4$ represent identical or different $C_1$-$C_{22}$ alkyl functional groups, $C_7$-$C_{28}$ aralkyl functional groups or heterocyclic functional groups, where two functional groups, or, in the case of aromatic bonding such as in pyridine, even three functional groups form, together with the nitrogen atom, the heterocycle, for example a pyridinium or imidazolinium compound, and X" represents halide ions, sulfate ions, hydroxide ions, or similar anions.

It is preferable for the biocidal quaternary ammonium compound to be selected from the group comprising alkyltrimethylammonium halides, dialkyldimethylammonium halides, benzalkonium salts, pyridinium salts and mixtures thereof. It is particularly preferable for the biocidal quaternary ammonium compound to be a dialkyldimethylammonium halide selected from the group comprising di-n-decyldimethylammonium chloride, didecyldimethylammonium bromide, dioctyldimethylammonium chloride and mixtures thereof.

These biocidal quaternary ammonium compounds are effective against viruses, bacteria, mold fungi or yeast fungi that adhere to textiles.

QAC may be prepared by reacting tertiary amines with alkalizing agents, for example methyl chloride, benzyl chloride, dimethyl sulfate, dodecyl bromide, but also ethylene oxide. The alkylation of tertiary amines with a long alkyl functional group and two methyl groups is particularly simple; the quaternization of tertiary amines with two long functional groups and a methyl group may also be carried out under mild conditions using methyl chloride. Amines having three long alkyl functional groups or hydroxy-substituted alkyl functional groups are less reactive, and are preferably quaternized with dimethyl sulfate, for example.

Suitable QAC are, for example, benzalkonium chloride (N-alkyl-N,N-dimethyl-benzylammonium chloride, CAS No. 8001-54-5), Benzalkon B (m,p-dichlorobenzyl-dimethyl-C12-alkylammonium chloride, CAS No. 58390-78-6), benzoxonium chloride (benzyl-dodecyl-bis-(2-hydroxyethyl)-ammonium-chloride), cetrimonium bromide (N-hexadecyl-N,N,N-trimethylammonium bromide, CAS No. 57-09-0), benzethonium chloride (N,N-dimethyl-N-[2-[2-[p-(1,1,3,3-tetramethylbutyl)-phenoxy]ethoxy]ethyl]-benzylammonium chloride, CAS No. 121-54-0), dialkyldimethylammonium chloride such as didecyldimethylammonium chloride (CAS No. 7173-51-5), didecyldimethylammonium bromide (CAS No. 2390-68-3), dioctyldimethylammonium chloride, 1-cetylpyridinium chloride (CAS No. 123-03-5) and thiazolium iodides and mixtures thereof.

Particularly preferred QAC are dialkyldimethylammonium chlorides, in particular didecyldimethylammonium chloride, N-octadecyl-N,N,N-trimethylammonium chloride, N-hexadecyl-N,N,N-trimethylammonium chloride and the benzalkonium chlorides having C8-C18-alkyl functional groups, in particular $C_{12}$-$C_{14}$-alkylbenzyldimethylammonium chloride. Another preferred biocidal compound is methyl-N-(2-hydroxyethyl)-N,N-di(caproyloxyethyl)ammonium-methosulfate. Aside from the fact that these biocidal compounds are effective against numerous microorganisms, the cationic compounds attach particularly well to cotton-containing fabrics and fabric blends.

The dialkyldimethylammonium halides, the benzalkonium halides and/or substituted benzalkonium halides are commercially available as Bardac® or Barquat® ex Lonza, Marquat® ex Mason, Variquat® ex Evonik Industries and Hyamine® ex Lonza, for example.

The biocidal quaternary ammonium compound is preferably used in an amount of from 0.1 wt. % to 20 wt. %, preferably 0.5 wt. % to 10 wt. %, and particularly preferably 1 wt. % to 5 wt. %, in each case based on the total amount of the washing or cleaning agent. From a toxicological and ecological perspective, it is particularly preferable for the amount of biocidal quaternary ammonium compound to be less than 3 wt. %.

The washing or cleaning agent according to the invention contains at least one surfactant as another essential component. In this case, the at least one surfactant can be a non-ionic, cationic, anionic and/or zwitterionic surfactant. According to the invention, soaps are not comprised by the surfactants, but may likewise be a component of the washing or cleaning agent according to the invention.

In this case, the washing or cleaning agent according to the invention may comprise a surfactant or mixtures of 2, 3 or more surfactants. If the washing or cleaning agent comprises more than one surfactant, these can be 2, 3 or more different amphoteric (zwitterionic) surfactants, for example. However, it is also possible to combine 1, 2, 3 or more non-ionic surfactants, for example having 1, 2, 3 or more cationic surfactants. Suitable surfactants are sufficiently described in the prior art.

The washing or cleaning agent preferably comprises non-ionic and/or cationic and/or zwitterionic surfactants. Preferred washing or cleaning agents according to the invention are further characterized in that they contain less than 1.0 wt. % and in particular no anionic surfactant.

All non-ionic surfactants that are known to a person skilled in the art can be used as non-ionic surfactants. Preferably, low-foaming nonionic surfactants are used, in particular alkoxylated, especially ethoxylated, low-foaming non-ionic surfactants.

Suitable non-ionic surfactants include alkyl glycosides of the general formula $RO(G)_x$, for example, in which R corresponds to a primary straight-chain or methyl-branched aliphatic functional group, in particular an aliphatic functional group that is methyl-branched in the 2 position, having 8 to 22, preferably 12 to 18 C atoms, and G is the symbol that stands for a glycose unit having 5 or 6 C atoms, preferably for glucose. The degree of oligomerization x, which indicates the distribution of monoglycosides and oligoglycosides, is any number between 1 and 10; preferably x is from 1.2 to 1.4.

Another class of preferred non-ionic surfactants, which are used either as the sole non-ionic surfactant or in combination with other non-ionic surfactants, are alkoxylated, preferably ethoxylated or ethoxylated and propoxylated fatty acid alkyl esters, preferably having 1 to 4 carbon atoms in the alkyl chain.

The washing or cleaning agent according to the present invention particularly preferably comprises one or more amine oxides as the non-ionic surfactant. Amine oxides that can preferably be used are, for example, N-coconut alkyl-N,N-dimethyl amine oxide, N-tallow alkyl-N,N-dihydroxyethyl amine oxide, myristyl cetyl dimethyl amine oxide or lauryldimethylamine oxide. The amount of amine oxide is preferably up to 5 wt. %, more preferably between 0.5 and 3 wt. % and particularly preferably between 1 and 2 wt. %, in each case based on the total amount of liquid washing or cleaning agent.

One advantage of using an amine oxide is that, for liquid formulations of washing or cleaning agents, the matrix thereof is stabilized such that the presence of, for example, alkoxylated fatty alcohols or even optical brighteners is stabilized.

In a preferred embodiment, the washing or cleaning agent according to the invention further comprises one or more ethoxylated fatty alcohols. Primary alcohols having preferably 8 to 18 C atoms and, on average, 1 to 12 mols of ethylene oxide (EO) per mol of alcohol are used in particular as alkoxylated fatty alcohols. However, alcohol ethoxylates having linear functional groups of alcohols of native origin having 12 to 18 C atoms, for example of coconut, palm, tallow fatty or oleyl alcohol, and an average of 2 to 8 EO per mol of alcohol are particularly preferred. Examples of preferred ethoxylated alcohols are $C_{12-14}$ alcohols having 3 EO, 4 EO or 7 EO, $C_{12-18}$ alcohols having 3 EO, 5 EO or 7 EO, and mixtures thereof. The degrees of ethoxylation indicated represent statistical averages that can correspond to an integer or a fractional number for a specific product. Preferred alcohol ethoxylates have a narrowed homolog distribution (narrow range ethoxylates, NRE). In addition to these non-ionic surfactants, fatty alcohols having more than 12 EO can also be used. Examples of these are tallow fatty alcohols having 14 EO, 25 EO, 30 EO, or 40 EO. Alkoxylated fatty alcohols that contain EO and PO groups together in the molecule can also be used according to the invention. Furthermore, a mixture of a (more highly) branched ethoxylated fatty alcohol and an unbranched ethoxylated fatty alcohol, such as a mixture of a $C_{16-18}$ fatty alcohol having 7 EO and 2-propylheptanol having 7 EO. Particularly preferably, the washing or cleaning agent contains a $C_{12-18}$ fatty alcohol having 7 EO as the alkoxylated fatty alcohol.

In an alternative embodiment, the liquid washing or cleaning agent is free of alkoxylated fatty alcohols, since these lead to slight clouding of the liquid washing or cleaning agent and, as a result, to a product that is less aesthetically appealing for some users.

In a preferred embodiment, the washing or cleaning agent contains, based on the total amount of washing or cleaning agent, up to 2 wt. % of optical brightener.

Suitable optical brighteners comprise, for example, compounds from the classes of bisstyrylbenzenes, Silibene, benzoxazoles, coumarins, pyrenes and naphthalenes. Commercially available optical brighteners are sold under the trademarks Tinopal®, Uvitex® (both from Ciba Speciality Chemicals), Ultraphor® (BASF SE) and Blankophor® (Bayer).

Particularly preferred optical brighteners include disodium-4,4'-bis-(2-morpholino-4-anilino-striazine-6-yl amino)stilbene disulfonate, disodium-2,2'-bis-(phenyl-styryl)disulfonate, 4,4'-bis[(4-anilino-6-[bis(2-hydroxyethyl)amino]-1,3,5-triazine-2-yl)amino]stilbene-2,2'-disulfonic acid, hexasodium-2,2'-[vinylenebis[(3-sulphonato-4,1-phenylene)imino[6-(diethylamino)-1,3,5-triazine-4,2-diyl]imino]]bis-(benzene-1,4-disulfonate), 2,2'-(2,5-thiophendiyl)bis[5-1,1-dimethylethyl)-benzoxazole, 4-methyl-7-(diethylamino)coumarin and/or 2,5-bis(benzoxazole-2-yl) thiophene.

In a preferred embodiment, the washing or cleaning agent is a solid cleaning agent. In a likewise preferred embodiment, the washing or cleaning agent is liquid. In the case of a liquid washing or cleaning agent, another preferred ingredient is boric acid or a salt of the boric acid. If the liquid washing or cleaning agent contains a salt of boric acid, it is particularly preferred for this to be potassium salt, i.e. potassium borate. The addition of boric acid or a salt of boric acid (borate) leads to an increase in the antimicrobial performance of the liquid washing or cleaning agent. In particular, the antimicrobial performance against fungi is increased, it being possible to observe a particular increase in performance against *Candida albicans*.

Using the washing or cleaning agent according to the invention, an excellent antimicrobial performance is also achieved in the absence of conventional disinfectants such as bleaching agents, for example halogens, halogenated compounds or bleaching agents based on active oxygen. However, it is also possible for the washing or cleaning agent according to the invention to comprise, in addition to the QAC, one of the mentioned conventional antimicrobial agents. However, the washing or cleaning agent according to the invention is preferably free of these.

In a preferred embodiment, the washing or cleaning agent according to the invention further comprises a water-soluble salt, in particular in the case of liquid washing or cleaning agents. The salt influences the viscosity of the composition. In this case, the salt can either be inorganic or organic. The washing or cleaning agent in liquid form preferably comprises an inorganic salt, which is preferably selected from the group that comprises colorless, water-soluble halides, sulfites, carbonates, hydrogen carbonates, nitrates, nitrites, phosphates and/or alkali metal oxides, alkaline-earth metal oxides, aluminum oxides and/or transition metal oxides. In addition, ammonium salts can also be used. Particularly preferred are halides and sulfates of alkali metals, particularly preferred are sodium chloride, potassium chloride, sodium sulfate, potassium sulfate and mixtures of these salts. Sodium chloride is particularly preferred.

If an organic salt is used, colorless water-soluble salts of a carboxylic acid are particularly preferred. In this case, the salt may be an alkali metal salt, alkaline-earth metal salt, ammonium salt, aluminum salt, and/or transition metal salt. The salt is preferably selected from the group comprising formiates, acetates, propionates, citrates, maleates, tartrates, succinates, malonates, oxalates, lactates and mixtures thereof.

In addition to the three essential components, the washing or cleaning agent can contain further ingredients which further improve the practical and/or aesthetic properties of the washing or cleaning agent. Within the scope of the present invention, the washing or cleaning agent additionally contains one or more substances from the group of non-ionic surfactants, builders, bleaching agents, bleach catalysts, bleach activators, enzymes, electrolytes, non-aqueous solvents, pH adjusters, perfume compositions, perfume carriers, fluorescing agents, dyes, hydrotropic substances, foam inhibitors, silicone oils, soil release polymers, graying inhibitors, anti-shrink agents, crease protection agents, dye transfer inhibitors, additional antimicrobial active ingredients, germicides, fungicides, antioxidants, preservatives, corrosion inhibitors, antistatic agents, bitters, ironing aids, repellents and impregnating agents, swelling agents and non-slip agents, softening components and UV absorbers.

The use of builder substances (builders) such as silicates, aluminum silicates (particularly zeolites), salts of organic di- and polycarboxylic acids, as well as mixtures of these substances, preferably water-soluble builder substances, in the washing or cleaning agent according to the invention can be advantageous. The builders include, in particular, carbonates, citrates, phosphonates, organic builders, and silicates. The proportion by weight of the total builders with respect to the total weight of washing or cleaning agents according to the invention is preferably 15 to 80 wt. % and in particular 20 to 70 wt. %.

In an embodiment that is preferred according to the invention, the use of phosphates (including polyphosphates) is omitted either largely or completely. In this embodiment, the washing or cleaning agent preferably contains less than 5 wt. %, particularly preferably less than 3 wt. %, in particular less than 1 wt. % phosphate(s). Particularly preferably, the washing or cleaning agent in this embodiment is completely phosphate-free, i.e., the washing or cleaning agents contain less than 0.1 wt. % phosphate(s).

In another embodiment, the present invention relates to the use of tetracarboxylic acids and salts thereof for synergistically enhancing the antimicrobial effect of biocidal quaternary ammonium compounds in washing or cleaning agents. With regard to preferred embodiments, reference is made to the above embodiments. The tetracarboxylic acid glutamic acid-N,N-diacetic acid is preferred. The salt of the tetracarboxylic acid is preferably ammonium salt or an alkali metal salt.

The invention also relates to the use of a washing or cleaning agent according to the invention in washing, cleaning and/or pretreating textile fabrics or hard surfaces. Washing or cleaning agents within the meaning of the present invention are in particular household cleaners, washing, cleaning or pretreatment agents or freshening sprays for textiles, fabric softeners, cosmetic products or air care products, for example room sprays or air fresheners. Household cleaners within the meaning of the present invention are, for example, cleaning agents for cleaning hard surfaces, window cleaners, bath cleaners, WC cleaners or dishwashing detergents (hand dishwashing detergents and dishwashing detergents for machine use). Cosmetic products within the meaning of the present invention are products for the cosmetic treatment of skin and hair (skin treatment agents, hair treatment agents), for example hair shampoos, hair rinses, deep conditioners, conditioners, agents for bleaching, coloring or shaping the hair, such as coloring agents, bleaching agents, toning agent, color-fixing agents, wave-setting agents or styling preparations such as hair stabilizers, styling mousses or styling gels, shower gels, body creams, body lotions, face creams or deodorants.

In a preferred embodiment of the invention, the washing or cleaning agent is a washing or cleaning agent in liquid form, preferably in gel form. Preferred liquid washing or cleaning agents have a water content of in particular from 3 to 95 wt. %, preferably 8 to 80 wt. %, and in particular 25 to 70 wt. %, based on the total weight of the washing or cleaning agent. In the case of liquid concentrates, the water content may also be lower and may be 30 wt. % or less, preferably 20 wt. % or less, in particular 15 wt. % or less. Here too, the specifications in wt. % are in each case based on the total weight of the agent. In addition to water, the liquid agents can also have additional non-aqueous solvents. A preferred liquid, in particular gel-form, washing agent according to the invention can preferably comprise components selected from the following:

- anionic surfactants, such as preferably alkylbenzene sulfonate, alkyl sulfate, in particular in a proportion of from 5 to 40 wt. %; in this case one anionic surfactant or mixtures of different anionic surfactants may be contained,
- non-ionic surfactants, such as preferably fatty alcohol polyglycol ether, alkyl polyglucoside, fatty acid glucamide, preferably in amounts of from 0.5 to 25 wt. % of one or more non-ionic surfactants,
- one or more builders, for example zeolite, polycarboxylate, sodium citrate, advantageously in an amount of from 0 to 15 wt. %, preferably 0.01 to 10 wt. %, in particular 0.1 to 5 wt. %,
- one or more foam inhibitors, for example soap, silicone oils, paraffins, preferably in amounts of from 0 to 10 wt. %, advantageously 0.1 to 4 wt. %, preferably 0.2 to 2 wt. %, in particular 1 to 3 wt. %,
- enzymes, for example proteases, amylases, cellulases, lipases, preferably in amounts of from 0 to 3 wt. %, advantageously 0.1 to 2 wt. %, preferably 0.2 to 1 wt. %, in particular 0.3 to 0.8 wt. %,
- optical brighteners, for example stilbene derivative, biphenyl derivative, in particular in amounts of from 0 to 1 wt. %, advantageously 0.1 to 0.3 wt. %, in particular 0.1 to 0.4 wt. %,
- optionally fragrances, for example perfume oils,
- optionally stabilizers,
- water,
- optionally soap, in particular from 0 to 25 wt. %, advantageously 1 to 20 wt. %, preferably 2 to 15 wt. %, particularly 5 to 10 wt. %,
- optionally non-aqueous solvent, in particular alcohols, advantageously from 0 to 25 wt. %, preferably 1 to 20 wt. %, in particular 2 to 15 wt. %.

The specifications in wt. % refer in each case to the total weight of the washing or cleaning agent.

In another preferred embodiment, the washing or cleaning agent is a liquid softener, which can preferably contain additional components that are selected from the following:

- cationic surfactants, such as in particular esterquats, preferably in amounts of from 5 to 30 wt. %,
- cosurfactants, for example glycerol monostearate, stearic acid, fatty alcohols, fatty alcohol ethoxylates, in particular in amounts of from 0 to 5 wt. %, preferably 0.1 to 4 wt. %,
- emulsifiers, for example fatty amine ethoxylates, in particular in amounts of from 0 to 4 wt. %, preferably 0.1 to 3 wt. %,
- optionally fragrances, for example perfume oils,
- optionally dyes, preferably in the ppm range,
- optionally stabilizers, preferably in the ppm range,
- Solvents, such as in particular water, in amounts of preferably 60 to 90 wt. %.

The specifications in wt. % relate in each case to the total weight of the formulation, i.e. of the softener. The specifications in ppm refer to the weight (wt. ppm).

A washing or cleaning agent according to the invention is prepared by means of conventional and known methods and processes.

The present invention further relates to a method for cleaning hard surfaces or textile fabrics using tetracarboxylic acids or salts thereof or a washing or cleaning agent as described above, in which method the tetracarboxylic acid and salts thereof or the washing or cleaning agent according to the invention are brought into contact with the surface to be cleaned/with the textile fabric. The contact can be carried out, for example, by the washing or cleaning agent or the tetracarboxylic acid or tetracarbonate being applied to the surface to be cleaned/to the textile fabric to be cleaned by means of spray application. Hard surfaces in particular can also be cleaned by bringing a cleaning cloth, which comprises a washing or cleaning agent according to the invention or tetracarboxylic acid/tetracarbonate together with biocidal quaternary ammonium compounds, into contact with the hard surface. It is also possible for a corresponding cleaning cloth, for example when machine-cleaning textile fabrics, to be added into a washing machine together with said fabrics, so as to allow an enhanced antimicrobial effect during the washing cycle.

EMBODIMENTS

Example 1: QAC-Containing Washing Agent for Textiles

A commercially available liquid washing agent, which comprised 2.2% a.i. QAC (benzalkonium chloride), was used as a reference. The pH was approximately 6. The washing agent had the following composition:

| Components: | Proportion in % a.i. |
|---|---|
| Anionic surfactant | 1-10 |
| Non-ionic surfactant | 2-8 |
| Builder (citric acid and phosphonates) | 0-3 |
| Caustic soda | 0.1-1 |
| Palm kernel oil fatty acid | 0-1 |
| Glycerol | 0-1 |
| Sodium chloride | 0.5-3 |
| Enzymes (protease, amylase, cellulase, lipase) | 0-3 |
| Boric acid | 0.1-2 |
| Other additives (preservative, defoamer, optical brightener, dye, perfume) | 0-1 |
| Water | Remainder |

a.i.: active ingredient

The washing agent was used in a test for determining the reduction of Pseudomonas aeruginosa according to EN 1276. The obtained value served as a reference.

0.10 wt. % GLDA or 0.50 wt. % were then added to the washing agent and likewise used in the test for determining the reduction of Pseudomonas aeruginosa according to EN 1276.

In the following Table 1, the proportions of QAC and GLDA are again summarized.

TABLE 1

| Concentration glutamic acid diacetic acid | Glutamic acid diacetic acid (GLDA) | Liquid washing agent with QAC |
|---|---|---|
| 0.00% (reference) | | 4.60E+01 |
| 0.10% (according to the invention) | 7.65E+00 | 8.70E+03 |
| 0.50% (according to the invention) | 6.90E+01 | 1.90E+05 |

The results of the measurement are shown in FIG. 1.

Using the liquid washing agent, which exclusively comprised QAC, the number of pathogens could be reduced. An antibacterial effect can be observed here owing to the QAC. Surprisingly, the effect could be significantly enhanced by using GLDA, although GLDA itself does not have an antimicrobial effect.

Example 2: QAC-Containing All-Purpose Cleaner

A commercially available liquid all-purpose cleaner, which comprised 0.5% a.i. QAC (DDAC), was used as a reference. The pH was approximately 5. The cleaner had the following composition:

| Components: | Wt. % |
|---|---|
| Na citrate | 15.00-20.00 |
| Na Percarbonate | 10.00-15.00 |
| QAC | 0.1-3 |
| Amphoteric surfactant | 0.00-10.00 |
| Non-ionic surfactant | 0.00-10.00 |
| Builder | 0.00-10.00 |
| Cationic copolymer | 0.00-0.75 |

-continued

| Components: | Wt. % |
|---|---|
| Enzymes | 2.00-8.00 |
| Other additives (preservative, defoamer, optical brightener, dye, perfume, etc.) | 0.05-10.00 |
| Water | Remainder (ad 100) |

The all-purpose cleaner was used in a test for determining the reduction of Pseudomonas aeruginosa according to EN 1276. The obtained value served as a reference.

0.10 wt. % GLDA or 0.50 wt. % were then added to the all-purpose cleaner and likewise used in the test for determining the reduction of Pseudomonas aeruginosa according to EN 1276.

In the following Table 2, the proportions of QAC and GLDA are again summarized.

TABLE 2

| Concentration glutamic acid diacetic acid | Glutamic acid diacetic acid | All-purpose (5%) cleaner |
|---|---|---|
| 0.00% (reference) | | 1.9E+02 |
| 0.10% (according to the invention) | 7.65E+00 | 3.1E+05 |
| 0.50% (according to the invention) | 6.90E+01 | 3.1E+05 |

Figure 2:
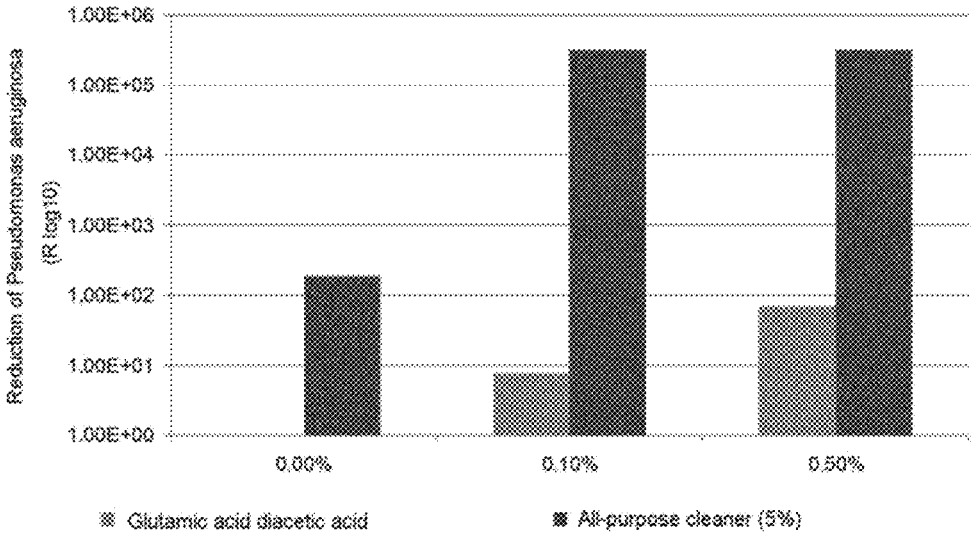
FIG. 2 shows the antibacterial effect based on the concentration of glutamic acid diacetic acid added to an all-purpose cleaner.

The results are shown in FIG. 2.

Using the all-purpose cleaner, which exclusively comprised QAC, the number of pathogens could be reduced. An antibacterial effect can be observed here owing to the QAC. Surprisingly, the effect could be significantly enhanced by using GLDA, although GLDA itself does not have an antimicrobial effect.

What is claimed is:

1. A washing or cleaning agent comprising a) from 5 to 40 wt. % of at least one anionic surfactant selected from the group consisting of alkylbenzene sulfonate, alkyl sulfate and mixtures thereof, b) from 0.5 to 25 wt. % of at least one non-ionic surfactant selected from the group consisting of fatty alcohol polyglycol ether, alkyl polyglucoside, fatty acid glucamide, and mixtures thereof, c) from 0.01 to 10 wt. % of one or more builders selected from the group consisting of zeolite, polycarboxylate, sodium citrate, and mixtures thereof, d) from 0.1 to 2 wt. % of enzymes selected from the group consisting of proteases, amylases, cellulases, and lipases, e) at least one biocidal quaternary ammonium compound selected from the group consisting of di-n-decyl-dimethylammonium chloride, didecyldimethylammonium bromide, dioctyldimethylammonium chloride and mixtures thereof, and f) from 0.05 to 3 wt. % of glutamic acid-N,N-diacetic acid.

2. A method for cleaning hard surfaces or textile fabrics using a washing or cleaning agent according to claim 1, wherein the washing or cleaning agent is brought into contact with the surface to be cleaned or with the textile fabric.

3. The method according to claim 2, wherein the contact is carried out by means of spray application.

* * * * *